US010369836B2

(12) United States Patent
Kim

(10) Patent No.: US 10,369,836 B2
(45) Date of Patent: Aug. 6, 2019

(54) KNOCK TYPE PEN

(71) Applicant: DONG-A PENCIL CO., LTD., Seoul (KR)

(72) Inventor: Hakjae Kim, Seoul (KR)

(73) Assignee: DONG-A PENCIL CO., LTD., Seoul (KR)

( * ) Notice: Subject to any disclaimer, the term of this patent is extended or adjusted under 35 U.S.C. 154(b) by 27 days.

(21) Appl. No.: 15/857,328

(22) Filed: Dec. 28, 2017

(65) Prior Publication Data

US 2019/0160854 A1 May 30, 2019

(30) Foreign Application Priority Data

Nov. 24, 2017 (KR) ..... 20-2017-0006033 U

(51) Int. Cl.
*B43K 24/08* (2006.01)
*B43K 7/12* (2006.01)

(52) U.S. Cl.
CPC ..... *B43K 24/082* (2013.01); *B43K 7/12* (2013.01)

(58) Field of Classification Search
CPC ..... B43K 24/00; B43K 24/02; B43K 24/08; B43K 24/082; B43K 24/084
See application file for complete search history.

(56) References Cited

U.S. PATENT DOCUMENTS 2,748,748 A * 6/1956 Lovejoy ..... B43K 24/08 401/114
3,657,812 A * 4/1972 Lee ..... B26B 1/08 30/162
3,679,317 A * 7/1972 Larson ..... B43K 24/084 401/109
3,985,455 A * 10/1976 Wahlberg ..... B43K 27/08 401/30
7,581,896 B2 * 9/2009 Yoon ..... B43K 24/08 401/104
8,783,988 B2 * 7/2014 Sanchez ..... A45D 34/04 401/109
9,415,625 B2 * 8/2016 Fisher ..... B43K 24/00

FOREIGN PATENT DOCUMENTS

KR 20-2016-0003130 9/2016

* cited by examiner

*Primary Examiner* — David P Angwin
*Assistant Examiner* — Bradley S Oliver

(57) ABSTRACT

A knock type pen including a housing in which a lead storing ink is received, a knock element which is placed moveably up and down in the housing, and has a button section protruding from an open upper side of the housing in an upper end part and a toothed protrusion coupled to a lower end part, and a rotary cam which is disposed between the lead and the knock element and rotatably placed in the housing, and has a guide protrusion which comes into contact with the toothed protrusion.

7 Claims, 7 Drawing Sheets

< Prior Art >

< Prior Art >

< Prior Art >

< Prior Art >

KNOCK TYPE PEN

CROSS-REFERENCE TO RELATED APPLICATION

This application claims priority of Korean Patent Application No. 20-2017-0006033, filed on Nov. 24, 2017, in the KIPO (Korean Intellectual Property Office), the disclosure of which is incorporated herein entirely by reference.

BACKGROUND OF THE INVENTION

Field of the Invention

The present disclosure relates to a knock type pen, and more particularly, to a knock type pen for preventing ink from leaking through the nib pushed out by a user's unintentional knock pressing and leaving stains on clothes or a bag.

Description of the Related Art

In general, a pen can be classified into a fixed type pen in which the lead is fixed and the nib is exposed to the outside or concealed using an opening/closing cap, a rotary type pen in which as a part of the shaft rotates, the lead makes a linear movement and accordingly the nib is pushed in and out, a knock type pen in which when a part of the shaft is pressed, a spring moves to push the nib out, and a slide type pen in which the lead slides the nib to push the nib in and out.

Among them, the knock type pen is convenient because of pushing the nib in and out in a simple manner through a motion of pressing a button section provided on the top of a housing.

This knock type pen is configured such that when the button section provided on the top of the housing is pressed once, the nib extends outside, turning into a writable state, and when the button section is pressed once again, the extended nib retracts into the housing, turning into a reception and protection state.

FIG. 1 is a diagram showing a conventional knock type pen, and FIG. 2 is an exploded view of a knock mechanism of the knock type pen of FIG. 1.

As shown in FIG. 1, the conventional knock type pen 10 is configured such that a lead 12 storing ink is received in a housing 11, and a knock body 15 which is manipulated moveably up and down is protrusively coupled to a slot (not shown) formed on the inner sidewall of the housing 11 in the upper part of the housing 11.

Furthermore, a rotary cam 16 is rotatably placed between the lead 12 and the knock body 15, and the knock body 15 and the rotary cam 16 form a knock mechanism 14 whereby the lead 12 is allowed to advance and draw back.

Moreover, a spring 21 is placed between the housing 11 and the lead 12 to apply an elastic force to the lead 12 in a direction in which the nib 13 retracts into the housing 11.

When a user presses a button section 17 protruding out of the housing 11 of the knock body 15, the lead 12 moves down and the nib 13 protruding at the end is pushed out of the housing 11.

In this instance, a guide protrusion 20 of the rotary cam 16 that comes into contact with a toothed protrusion 18 at the bottom of the knock body 15 slips out of the slot of the housing 11, and at the same time, slips out of one slope surface of the toothed protrusion 18 while rotating along the other slope surface, and the rotated guide protrusion 20 of the rotary cam 16 is stuck by a stopper step 19 protruding from the outer circumference of the knock body 15.

In this state, despite the elastic force of the spring 21 coupled to the nib 13, the lead 12 does not move up, so the nib 13 keeps being extended outside the housing 11.

When the nib 13 is extended outside, if the user presses the button section 17 again, the rotary cam 16 rotates by the method previously described so that the guide protrusion 20 of the rotary cam 16 is disposed between the stopper steps 19 of the knock body 15 and moves up by the elastic force of the spring 21 and thus the nib 13 retracts into the housing 21.

(a) in FIG. 3 is a diagram showing a shirt stained with ink due to ink leaks in the event that the button section of the knock type pen is pressed when the user puts the knock type pen on the shirt's pocket, (b) is an enlarged view of the contaminated part in (a), and FIG. 4 is a diagram showing a bag stained with ink due to ink leaks in the event that the button section of the knock type pen is pressed when the user puts the knock type pen in the bag.

The conventional knock type pen designed as above has a problem that when it is put on the user's clothes, for example, a pocket using a clip 22 provided on the side of the upper end of the housing 11 as shown in FIG. 3, or when it is put in a bag as shown in FIG. 4, the nib 13 is pushed out by the user's unintentional knock pressing, and ink leaks through the nib 13 extended outside, causing ink stains on the clothes or the bag.

In particular, recently, many knock type pens containing low viscosity ink to facilitate writing with a small force (pressure) are being offered. However, compared to high viscosity ink, low viscosity ink leaks in a higher amount from the nib due to the low viscosity, and when the nib is pushed out by an unintentional knock pressing as described above, larger ink stains leave on clothes or a bag because of better ability of absorption, resulting in more serious damage.

Korean Utility Model Publication No. 20-2016-0003130, published on Sep. 19, 2016, discloses a knock type pen.

SUMMARY OF THE INVENTION

The present disclosure is designed to solve the problems such as the foregoing, and therefore the present disclosure is directed to providing a knock type pen for preventing ink from leaking through the nib pushed out by a user's unintentional knock pressing and leaving stains on clothes or a bag.

To achieve the objects, the present disclosure provides a knock type pen including a housing in which a lead storing ink is received, a knock element which is placed moveably up and down in the housing, and has a button section protruding from an open upper side of the housing in an upper end part and a toothed protrusion coupled to a lower end part, and a rotary cam which is disposed between the lead and the knock element and rotatably placed in the housing, and has a guide protrusion which comes into contact with the toothed protrusion, wherein a fixing groove is formed around an outer circumferential surface of the knock element, the housing has a first through hole formed therethrough along an outer circumferential direction, and a second through hole formed therethrough corresponding to the first through hole, the knock type pen further includes a fixing element which is coupled to the housing linearly moveably in a direction perpendicular to a lengthwise direction of the housing, with one end formed over an outer circumference of the first through hole and the other end formed over an outer circumference of the second through hole, the fixing element having an insert groove corresponding to the fixing groove, and when one end of the fixing element is pressed in a direction toward the housing, the insert groove of the fixing element is inserted into to fixing groove of the knock element to limit a downward movement of the knock element.

Additionally, preferably, the knock element includes a first element in which the button section is formed, and a second element having an outer circumferential length that is smaller than an outer circumferential length of the first element, wherein the second element extends downward from a lower surface of the first element and has a fixing groove around an outer circumferential surface.

Further, preferably, a stopper is protrusively formed with a predetermined thickness on an outer circumferential surface of the first element or the second element around the outer circumferential surface.

Additionally, the fixing element includes a fixing section which is placed in the housing in a direction perpendicular to a lengthwise direction of the housing and makes a linear motion in the direction perpendicular to the lengthwise direction of the housing, and has an insert groove which is inserted into the fixing groove, a first stopper rib which extends from one side of the fixing section, and is formed over an outer circumference of the first through hole, and a second stopper rib which extends from the other side of the fixing section, and is formed over an outer circumference of the second through hole.

Moreover, preferably, the fixing section includes a body formed in plate shape in which one end is connected to the first stopper rib, and the other end has an insert groove corresponding to the fixing groove, and a pair of legs, each having a first end connected to each of two sides of the other end of the body, and a second end connected to each of a pair of second stopper ribs, the second element moves up between the pair of legs, and when the button section of the knock element is pressed, the stopper is put on the pair of legs.

In addition, preferably, the first stopper rib and the second stopper rib are curved so that the first stopper rib and the second stopper rib are in close contact with an outer circumferential surface of the housing.

The present disclosure has the following effect by the above problem-solving means.

The fixing groove is formed around the outer circumference of the knock element, and the fixing element having the insert groove that is inserted into the fixing groove is coupled to the housing, thereby preventing ink from leaking through the nib pushed out by the user's unintentional knock pressing and leaving stains on clothes or a bag.

In particular, in the case of use from low viscosity ink (300-3,000 cps) having relatively low viscosity to high viscosity ink (10,000-25,000 cps) having high viscosity, it can prevent ink from leaking out of the nib due to a knock pressing and leaving stains on clothes or a bag, and it can be applied to all writing instruments such as ballpoint pens employing low viscosity ink and high viscosity ink.

Additionally, the fixing element includes the fixing section having the insert groove and the first and second stopper ribs, allowing the user to easily manipulate the knock element.

Moreover, the first stopper rib and the second stopper rib are curved so that they are in close contact with the outer circumferential surface of the housing, thereby minimizing inconvenience when the user uses the pen while not harming aesthetic quality.

BRIEF DESCRIPTION OF THE DRAWINGS

The above and other features and advantages will become more apparent to those of ordinary skill in the art by describing in detail exemplary embodiments with reference to the attached drawings, in which.

Figure 1:
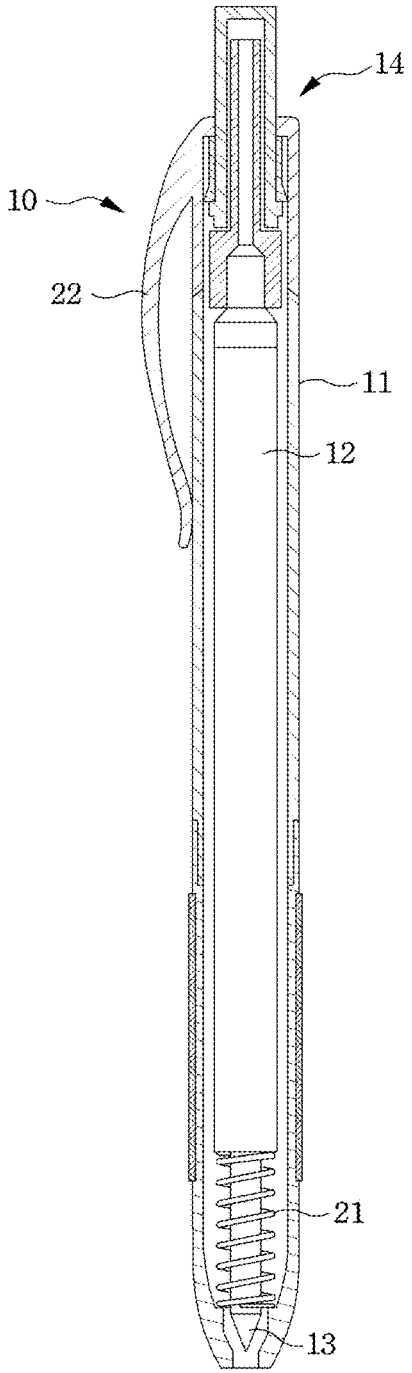
FIG. 1 is a diagram showing the conventional knock type pen.
Figure 2:
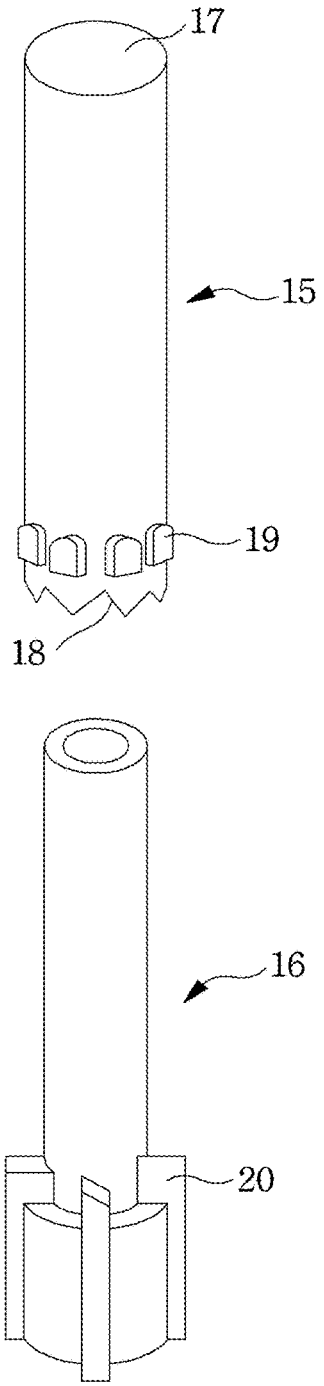
FIG. 2 is an exploded view of a knock mechanism of the knock type pen of FIG. 1.
Figure 3:
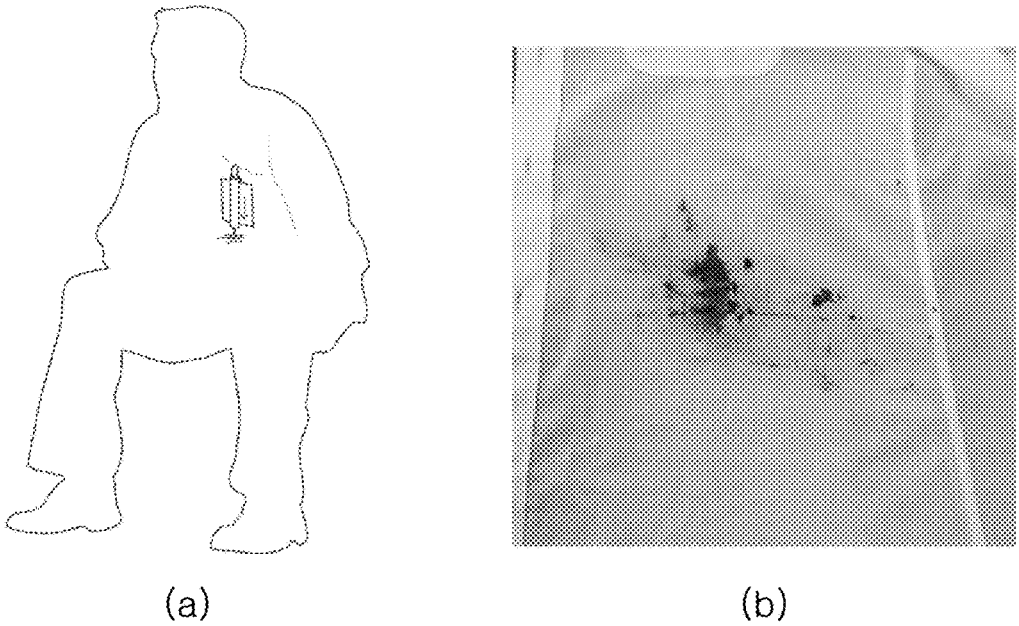

(a) in FIG. 3 is a diagram showing a shirt stained with ink due to ink leaks in the event that a button section of a knock type pen is pressed when a user puts the knock type pen on the shirt's pocket, and (b) is an enlarged view of the contaminated part in (a).

Figure 4:
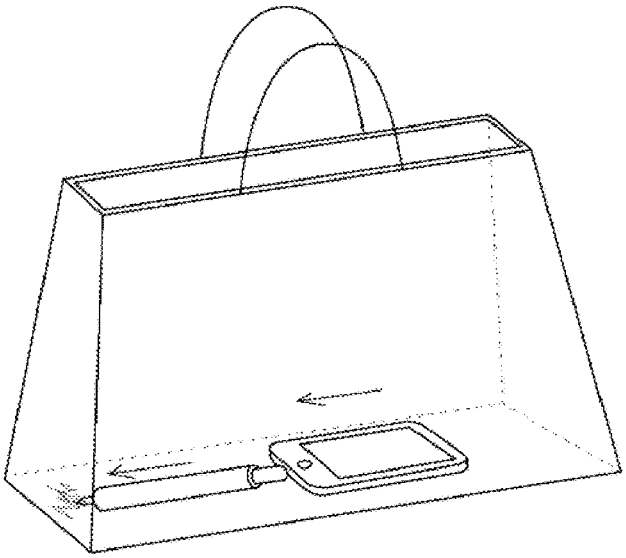

FIG. 4 is a diagram showing a bag stained with ink due to ink leaks in the event that a button section of a knock type pen is pressed when a user puts the knock type pen in the bag.

Figure 5:
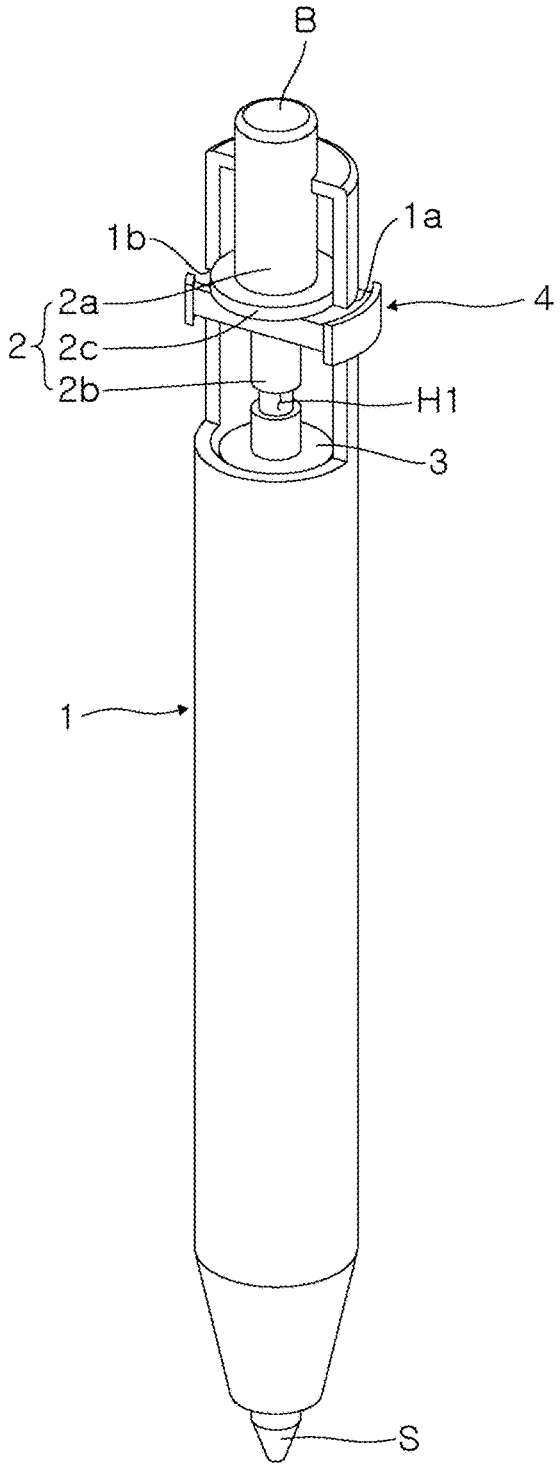

FIG. 5 is a diagram of a knock type pen according to the present disclosure showing that a nib is pushed out of a housing when a button section of a knock element is pressed.

Figure 6:
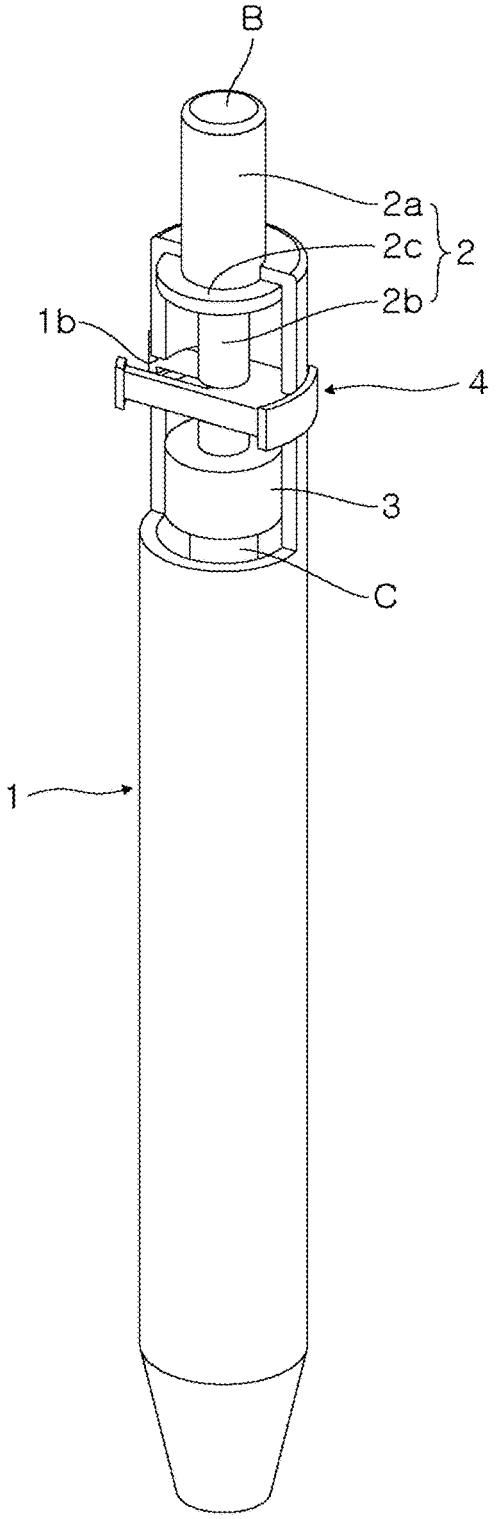

FIG. 6 is a diagram of a knock type pen according to the present disclosure showing that a fixing groove of a knock element is inserted into an insert groove formed in a fixing element.

Figure 7:
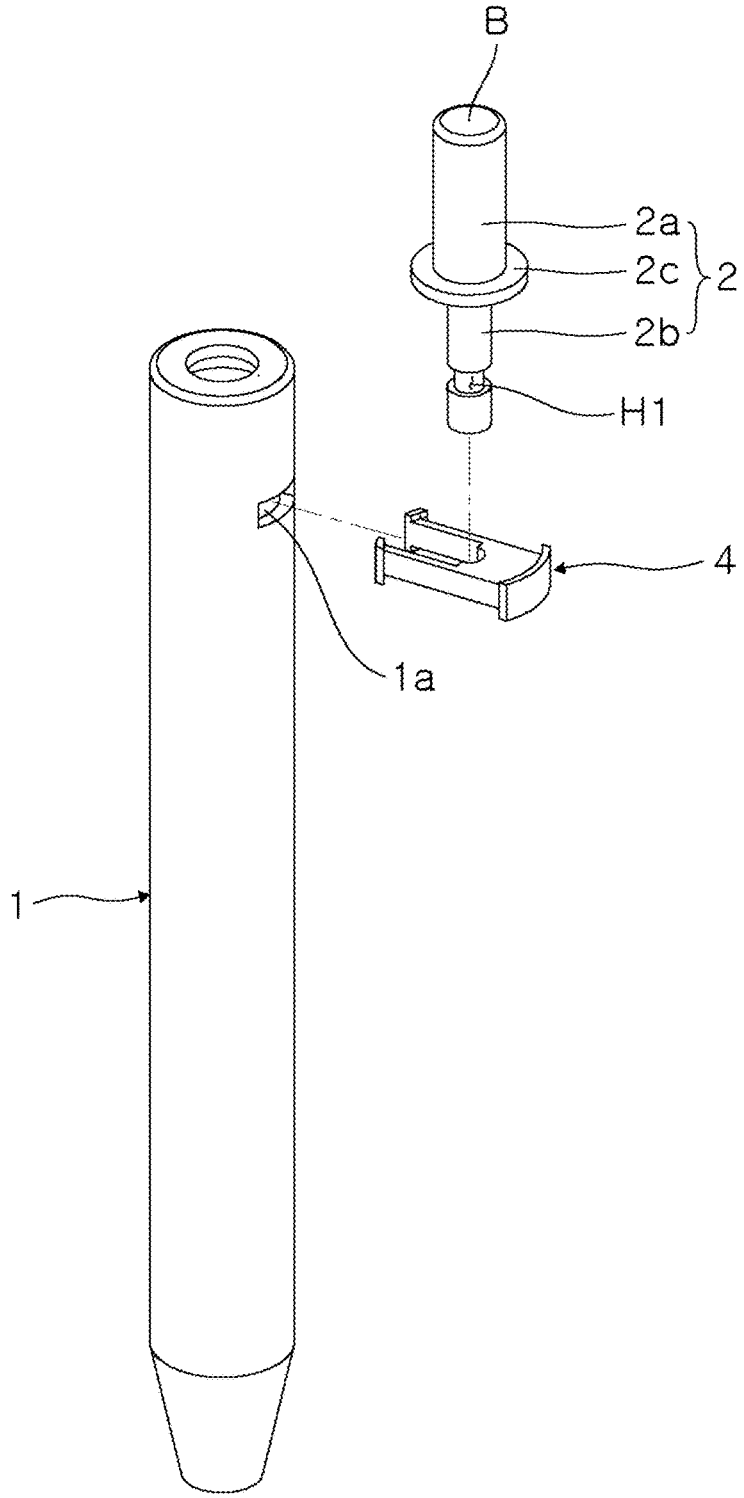

FIG. 7 is an exploded diagram of a knock element, a fixing element and a housing of a knock type pen according to the present disclosure.

Figure 8:
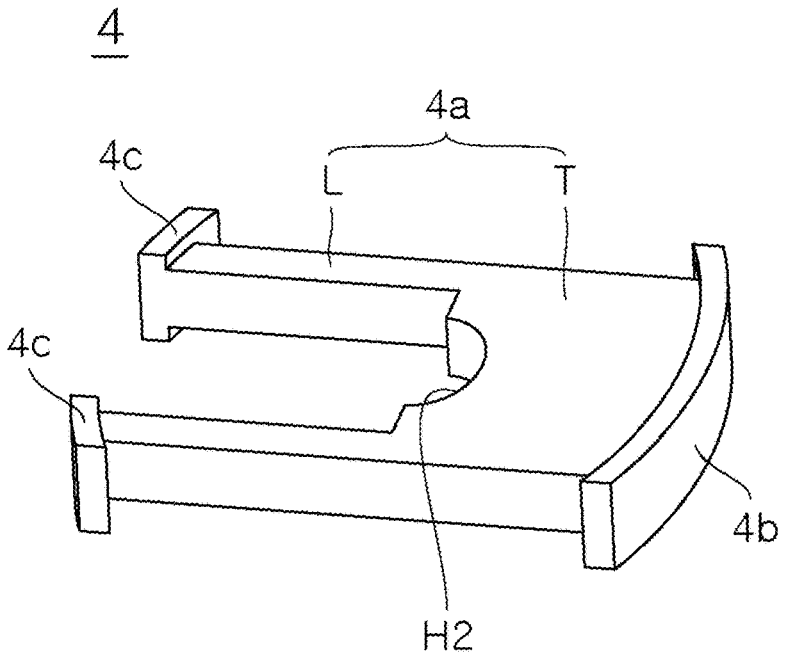

FIG. 8 is an enlarged view of a fixing element employed in a knock type pen according to the present disclosure.

Figure 9:
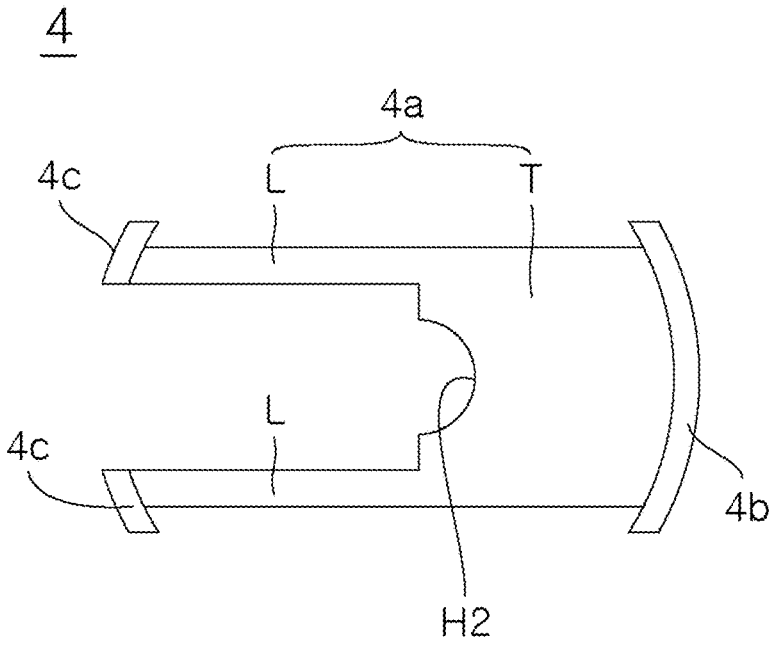

FIG. 9 is a plane view showing the fixing element of FIG. 8.

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Reference herein to a layer formed "on" a substrate or other layer refers to a layer formed directly on top of the substrate or other layer or to an intermediate layer or intermediate layers formed on the substrate or other layer. It will also be understood by those skilled in the art that structures or shapes that are "adjacent" to other structures or shapes may have portions that overlap or are disposed below the adjacent features.

In this specification, the relative terms, such as "below", "above", "upper", "lower", "horizontal", and "vertical", may be used to describe the relationship of one component, layer, or region to another component, layer, or region, as shown in the accompanying drawings. It is to be understood that these terms are intended to encompass not only the directions indicated in the figures, but also the other directions of the elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

FIGS. 5 to 9 are diagrams showing a knock type pen according to the present disclosure.

The knock type pen according to the present disclosure includes a housing 1, a knock element 2, and a rotary cam 3 as shown in FIGS. 5 to 7.

The housing 1 is in hollow shape in which a lead C storing ink is received.

The lead C is installed moveably up and down in the housing 1, and the lead C is subjected to an elastic force by a spring installed in the housing 1 in a direction in which a nib S at the end retracts into the housing 1.

Furthermore, as shown in FIGS. 5 to 7, the housing 1 has a first through hole 1*a* formed therethrough along the outer circumferential direction, and a second through hole 1*b* formed therethrough corresponding to the first through hole 1*a*.

The knock element 2 is placed moveably up and down in the housing 1, and as shown in FIG. 7, a button section B protruding from the open upper side of the housing 1 is formed in the upper end part of the knock element 2, and a toothed protrusion (not shown) is coupled to the lower end part and comes into contact with a guide protrusion (not shown) formed in the rotary cam 3 as described below.

As shown in FIG. 7, the knock element 2 includes a first element 2*a* and a second element 2*b* in cylindrical shape.

The first element 2*a* has the button section B on the upper end, and the button section B protrudes from the open upper side of the housing 1.

The second element 2*b* has an outer circumferential length that is smaller than an outer circumferential length of the first element 2*a*, extends downward from the lower surface of the first element 2*a*, and has a fixing groove H1 around the outer circumferential surface.

In this instance, a stopper 2*c* is protrusively formed with a predetermined thickness along the outer circumferential surface on the outer circumferential surface of the first element 2*a* or the second element 2*b*.

The rotary cam 3 is disposed between the lead C and the knock element 2 and rotatably placed in the housing 1, and the rotary cam 3 has the guide protrusion (not shown) that comes into contact with the toothed protrusion (not shown) coupled to the lower end part of the knock element 2.

The configuration that when a user presses the button section B of the knock element 2, the toothed protrusion of the knock element 2 and the guide protrusion of the rotary cam 3 are brought into contact to push the nib S out of the housing 1 is described in detail in the background part of the specification, and its description is omitted herein.

Meanwhile, as shown in FIG. 7, the knock type pen may further include a fixing element 4 that is coupled to the housing 1 linearly moveably in a direction perpendicular to the lengthwise direction of the housing 1, with one end formed over the outer circumference of the first through hole 1*a* and the other end formed over the outer circumference of the second through hole 1*b*, and the fixing element 4 has an insert groove H2 corresponding to the fixing groove H1 formed in the knock element 2.

As above, when one end of the fixing element 4 is pressed in a direction toward the housing 1, the insert groove H2 of the fixing element 4 is inserted into the fixing groove H1 of the knock element 2, thereby limiting the downward movement of the knock element 2.

As shown in FIGS. 8 and 9, the fixing element 4 includes a fixing section 4*a*, a first stopper rib 4*b* and a second stopper rib 4*c*.

The fixing section 4*a* is placed in the housing 1 in a direction perpendicular to the lengthwise direction of the housing 1 and makes a linear motion in the direction perpendicular to the lengthwise direction of the housing 1, and has the insert groove H2 that is inserted into the fixing groove H1 formed in the knock element 2.

The fixing section 4*a* includes a body T and a leg L.

The body T is in plate shape, and one end is connected to the first stopper rib 4*b* as described below, and the other end has the insert groove H2 corresponding to the fixing groove H1 formed in the knock element 2.

The leg L is formed in pair, and each first end is connected to each of two sides of the other end of the body T, and each second end is connected to each of a pair of second stopper ribs 4*c* as described below.

Accordingly, the second element 2*b* of the knock element 2 may make a linear motion upward and downward between the pair of legs L.

The first stopper rib 4*b* extends from one side of the fixing section 4*a* of the fixing element 4, and is formed over the outer circumference of the first through hole 1*a* formed in the housing 1.

The second stopper rib 4*c* extends from the other side of the fixing section 4*a* of the fixing element 4, and is formed over the outer circumference of the second through hole 1*b* formed in the housing 1.

In this instance, preferably the first stopper rib 4*b* and the second stopper rib 4*c* are curved so that they are in close contact with the outer circumferential surface of the housing 1, and accordingly, inconvenience is minimized when the user uses the pen while not harming aesthetic quality.

Moreover, when the second element 2*b* of the knock element 2 moves up between the pair of legs L of the fixing section 4*a*, and the button section B of the knock element 2 is pressed, the stopper 2*c* is put on the pair of the legs L of the fixing section 4*a*.

As above, the present disclosure forms the fixing groove H1 around the outer circumferential surface of the knock element 2, and couples, to the housing 1, the fixing element 4 having the insert groove H2 that is inserted into the fixing groove H1, thereby preventing ink from leaking through the nib extended outside by the user's unintentional knock pressing and leaving stains on clothes or a bag.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A knock type pen comprising:

a housing in which a lead storing ink is received;

a knock element which is placed moveably up and down in the housing, and has a button section protruding from an open upper side of the housing in an upper end part and a toothed protrusion coupled to a lower end part; and a rotary cam which is disposed between the lead and the knock element and rotatably placed in the housing, and has a guide protrusion which comes into contact with the toothed protrusion, wherein a fixing groove is formed around an outer circumferential surface of the knock element, wherein the housing has a first through hole formed therethrough along an outer circumferential direction, and a second through hole formed therethrough corresponding to the first through hole, wherein the knock type pen further comprises a fixing element which is coupled to the housing linearly moveably in a direction perpendicular to a lengthwise direction of the housing, with one end formed over an outer circumference of the first through hole and the other end formed over an outer circumference of the second through hole, the fixing element having an insert groove corresponding to the fixing groove, wherein when one end of the fixing element is pressed in a direction toward the housing, the insert groove of the fixing element is inserted into to fixing groove of the knock element to limit a downward movement of the knock element.

2. The knock type pen of claim 1, wherein the knock element comprises:

a first element in which the button section is formed; and a second element having an outer circumferential length that is smaller than an outer circumferential length of the first element, wherein the second element extends downward from a lower surface of the first element and has the fixing groove around an outer circumferential surface.

3. The knock type pen of claim 2, wherein a stopper is protrusively formed with a predetermined thickness on an outer circumferential surface of the first element or the second element around the outer circumferential surface.

4. The knock type pen of claim 3, wherein the fixing element comprises:

a fixing section which is placed in the housing in a direction perpendicular to a lengthwise direction of the housing and makes a linear motion in the direction perpendicular to the lengthwise direction of the housing, and has the insert groove which is inserted into the fixing groove;

a first stopper rib which extends from one side of the fixing section, and is formed over an outer circumference of the first through hole; and a second stopper rib which extends from the other side of the fixing section, and is formed over an outer circumference of the second through hole.

5. The knock type pen of claim 4, wherein the fixing section comprises:

a body formed in plate shape in which one end is connected to the first stopper rib, and the other end has the insert groove corresponding to the fixing groove; and a pair of legs, each having a first end connected to each of two sides of the other end of the body, and a second end connected to each of a pair of second stopper ribs, wherein the second element moves up between the pair of legs, wherein when the button section of the knock element is pressed, the stopper is put on the pair of legs.

6. The knock type pen of claim 4, wherein the first stopper rib and the second stopper rib are curved so that the first stopper rib and the second stopper rib are in close contact with an outer circumferential surface of the housing.

7. The knock type pen of claim 5, wherein the first stopper rib and the second stopper rib are curved so that the first stopper rib and the second stopper rib are in close contact with an outer circumferential surface of the housing.

* * * * *